US005937774A

United States Patent [19]

Hayashi

[11] Patent Number: 5,937,774

[45] Date of Patent: Aug. 17, 1999

[54] WORK-SHEET HOLDER CONNECTING APPARATUS FOR SEWING MACHINE

[75] Inventor: Koji Hayashi, Gifu-ken, Japan

[73] Assignee: Brother Kogyo Kabushiki Kaisha, Nagoya, Japan

[21] Appl. No.: 08/853,495

[22] Filed: May 8, 1997

[30] Foreign Application Priority Data

May 13, 1996 [JP] Japan ..... 8-143666

[51] Int. Cl.[6] ..... D05C 9/04; D05C 9/22

[52] U.S. Cl. ..... 112/103; 112/155; 112/470.14; 112/475.11

[58] Field of Search ..... 112/470.14, 470.06, 112/103, 102.5, 63, 155, 163, 167, 475.11, 114, 311; 38/102.2

[56] References Cited

U.S. PATENT DOCUMENTS

| | | | |
|---|---|---|---|
| 994,033 | 5/1911 | Richter | 112/103 |
| 1,159,901 | 11/1915 | Corrall et al. | 112/103 |
| 4,998,964 | 3/1991 | Golia | 112/103 X |
| 5,014,633 | 5/1991 | Murata et al. | 112/470.14 |
| 5,146,859 | 9/1992 | Conley, Jr. et al. | 112/114 |
| 5,277,140 | 1/1994 | Nakagaki | 112/102.5 |
| 5,415,116 | 5/1995 | Nishio . | |
| 5,445,090 | 8/1995 | Conley, Jr. | 112/470.06 X |
| 5,694,496 | 12/1997 | Morita et al. | 112/103 |
| 5,701,831 | 12/1997 | Morita | 112/103 |

FOREIGN PATENT DOCUMENTS

A 6-126054 5/1994 Japan .

*Primary Examiner*—Peter Nerbun
*Attorney, Agent, or Firm*—Oliff & Berridge, PLC

[57] ABSTRACT

An apparatus for connecting a work-sheet holder which holds a work sheet, to a feed member which is fed by a feeding device of a sewing machine, so that a stitch-forming device of the sewing machine forms stitches on the work sheet held by the work-sheet holder, the apparatus including a position adjusting device which adjusts at least one of a position of the work-sheet holder relative to the feed member in a first direction, a position of the work-sheet holder relative to the feed member in a second direction perpendicular to the first direction, and an angular position of the work-sheet holder relative to the feed member about an axis line parallel to a third direction perpendicular to the first and second directions, and a holder fixing device which fixes the work-sheet holder at the adjusted one position thereof.

21 Claims, 9 Drawing Sheets

WORK-SHEET HOLDER CONNECTING APPARATUS FOR SEWING MACHINE

BACKGROUND OF THE INVENTION

1. Field of the Invention

The present invention generally relates to a work-sheet holder connecting apparatus for a sewing machine and particularly to such an apparatus which connects a work-sheet holder to a feed member which is fed by a feeding device of the sewing machine.

2. Related Art Statement

Japanese Patent Application laid open for inspection under Publication No. 6-126054 discloses a multiple-head embroidering machine as an industrial sewing machine suitable for sewing a predetermined pattern or embroidery.

The above sewing machine includes a plurality of sewing heads which are provided at a regular interval in an X direction, a plurality of sewing beds corresponding to the sewing heads, respectively, a feeding device, and a common feed member which is fed by the feeding device in the X direction and a Y direction independent of each other and to which a plurality of work-sheet holders are connected. Each sewing head includes a needle-bar case which accommodates a plurality of needle bars for supporting a plurality of sewing needles which convey color-different embroidering threads, respectively. The needle-bar case is displaceable in the X direction. The sewing machine additionally includes a main shaft and a main motor for driving or rotating the main shaft so that the rotation of the main shaft is transmitted to an upper and a lower shaft of each pair of sewing head and sewing bed.

In the prior sewing machine, the work-sheet holders are connected to the common feed member via a plurality of connector members, respectively. The connector members are connected to predetermined positions on the feed member, respectively. Each of the work-sheet holders is detachably attached to a predetermined position on a corresponding one of the connector members. A work sheet on which an embroidery pattern is to be formed is set on each of the work-sheet holders. Thus, the work-sheet holders are moved by the feeding device in the X and Y directions in synchronism with each other via the feed member and the connector members.

Therefore, an operator must set a plurality of work sheets on the work-sheet holders, respectively, in the same way, i.e., in such a way that respective embroidering areas of the work sheets have identical positions relative to the corresponding holders in the X and Y directions and have identical angular positions relative to the corresponding holders about corresponding vertical axis lines perpendicular to the X and Y directions. If a work sheet is set on a work-sheet holder in a different way, the work sheet must be repeatedly reset on the holder until the work sheet is set in the same way. This operation is very cumbersome and time-consuming, thereby lowering the work efficiency of the operator.

Meanwhile, U.S. Pat. No. 5,415,116 discloses another multiple-head embroidering machine for forming an embroidery pattern on a headgear such as a baseball cap. The second sewing machine includes a plurality of frame devices to which a plurality of headgear holders are detachably attached, respectively, and which are connected to a first feed member which extends in an X direction and is fed in a Y direction by a Y-direction feeding device and a second feed member which also extends in the X direction and is fed in the X direction by an X-direction feeding device. Each headgear holder holds a headgear on which embroidering stitches are to be formed. Thus, the headgear holders are moved in the Y direction and are rotated about respective axis lines parallel to the Y direction via the first and second feed members, respectively. In this case, too, the frame devices are connected to predetermined positions on the first feed member, and each of the headgear holders is connected to a predetermined position on a corresponding one of the frame devices. Thus, the second sewing machine suffers from the same problems as the above-identified problems of the first sewing machine.

Even in a single-head sewing machine, a work sheet must be set on a single work-sheet holder such that an embroidering area of the work sheet is positioned with accuracy relative to the holder. Otherwise, an embroidery pattern is formed at an inaccurate position on the work sheet.

SUMMARY OF THE INVENTION

It is therefore an object of the present invention to provide a work-sheet holder connecting apparatus which is free from at least one of the above-identified problems.

The above object has been achieved by the present invention, which provides an apparatus for connecting a work-sheet holder which holds a work sheet, to a feed member which is fed by a feeding device of a sewing machine, so that a stitch-forming device of the sewing machine forms stitches on the work sheet held by the work-sheet holder, the apparatus comprising a position adjusting device which adjusts at least one of a position of the work-sheet holder relative to the feed member in a first direction, a position of the work-sheet holder relative to the feed member in a second direction perpendicular to the first direction, and an angular position of the work-sheet holder relative to the feed member about an axis line parallel to a third direction perpendicular to the first and second directions, and a holder fixing device which fixes the work-sheet holder at the adjusted one position thereof.

The work-sheet holder connecting apparatus constructed as described above permits an operator to easily set a work sheet on the work-sheet holder because, after having set the work sheet on the holder, the operator can finely adjust with accuracy at least one of the above-indicated three positions of the work-sheet holder relative to the feed member by operating the position adjusting device and the holder fixing device. That is, the operator does not have to position with accuracy a sewing area of the work sheet relative to the holder when setting the work sheet on the holder. Thus, the work efficiency of the operator is much improved.

According to a preferred feature of the present invention, the connecting apparatus further comprises a holder connecter which connects the work-sheet holder to the feed member such that the work-sheet holder is movable together with the feed member in at least one of the first and second directions.

According to another feature of the present invention, the connecting apparatus further comprises a holder connecter which connects the work-sheet holder to the feed member such that the work-sheet holder is movable together with the feed member in the first and second directions, wherein the position adjusting device comprises a first adjusting device which adjusts a position of the work-sheet holder relative to the holder connector in the first direction and a second adjusting device which adjusts a position of the holder connector relative to the feed member in the second direction, and wherein the holder fixing device comprising a first fixing device which fixes the work-sheet holder at the adjusted position thereof relative to the holder connector in the first direction and a second fixing device which fixes the holder connector at the adjusted position thereof relative to the feed member in the second direction.

According to another feature of the present invention, the first fixing device comprises at least one first through-hole formed through one of the work-sheet holder and the holder connector and at least one first fastener which passes through the first through-hole and fastens the one of the work-sheet holder and the holder connector to the other of the work-sheet holder and the holder connector, and the second fixing device comprises at least one second through-hole formed through one of the holder connector and the feed member and at least one second fastener which passes through the second through-hole and fastens the one of the holder connector and the feed member to the other of the holder connector and the feed member, and wherein the first adjusting device comprises at least one first elongate through-hole which is continuous with the first through-hole and extends in the first direction, and the second adjusting device comprises at least one second elongate through-hole which is continuous with the second through-hole and extends in the second direction. In this case, it can be said that the first or second position adjusting device and the first or second holder fixing device are provided by a single first or second position-adjusting and holder-fixing device comprising at least one elongate through-hole and at least one fastener passing through the elongate through-hole. However, alternatively, the first or second position adjusting device and the first or second holder fixing device may be provided independent of each other.

According to another feature of the present invention, the holder fixing device further comprises an angular position fixing device which fixes the work-sheet holder at the adjusted angular position thereof relative to the feed member about the axis line and which comprises at least one of the first and second through-holes and at least one of the first and second fasteners, and wherein the position adjusting device further comprises an angular position adjusting device which adjusts the angular position of the work-sheet holder relative to the feed member about the axis line parallel to the third direction and which comprises at least one of the first and second elongate through-holes.

According to another feature of the present invention, the position adjusting device comprises an angular position adjusting device which adjusts the angular position of the work-sheet holder relative to the feed member about the axis line parallel to the third direction, and wherein the position fixing device comprises an angular position fixing device which fixes the work-sheet holder at the adjusted angular position relative to the feed member about the axis line.

According to another feature of the present invention, the connecting apparatus is for connecting a plurality of work-sheet holders each of which holds a work sheet on which stitches are formed by a corresponding one of a plurality of stitch-forming devices of the sewing machine, to the feed member which is fed by the feeding device in the first direction in which an elongate housing of each of the stitch-forming devices in which a loop catcher is accommodated extends, and fed in the second direction independent of the feeding thereof in the first direction, wherein the connecting apparatus further comprises a plurality of holder connectors each of which connects a corresponding one of the work-sheet holders to the feed member such that the corresponding one work-sheet holder is movable together with the feed member in the first and second directions, and wherein the position adjusting device comprises a plurality of first adjusting devices each of which adjusts a position of a corresponding one of the work-sheet holders relative to a corresponding one of the holder connectors in one of the first-and second directions, and a plurality of second adjusting devices each of which adjusts a position of a corresponding one of the holder connectors relative to the feed member in the other of the first and second directions, and wherein the holder fixing device comprises a plurality of first fixing devices each of which fixes a corresponding one of the work-sheet holders at an adjusted position thereof relative to a corresponding one of the holder connectors in the one direction, and a plurality of second fixing devices each of which fixes a corresponding one of the holder connectors at an adjusted position thereof relative to the feed member in the other direction. In this case, an operator can easily set a work sheet on each of the work-sheet holders because, after having set the work sheet on each holder, the operator can finely adjust with accuracy the positions of each individual holder relative to the feed member in the first and second directions by operating the first and second adjusting devices and the first and second fixing devices associated with each holder. That is, the operator does not have to position with accuracy a sewing area of the work sheet relative to each holder when setting the work sheet on the holder. Thus, the work efficiency of the operator is much improved.

According to another feature of the present invention, the each first adjusting device adjusts the position of the corresponding one work-sheet holder relative to the corresponding one holder connector in the first direction, the each first fixing device fixes the corresponding one work-sheet holder at the adjusted position thereof relative to the corresponding one holder connector in the first direction, the each second adjusting device adjusts the position of the corresponding one holder connector relative to the feed member in the second direction, and the each second fixing device fixes the corresponding one holder connector at the adjusted position thereof relative to the feed member in the second direction.

According to another feature of the present invention, the position adjusting device further comprises a plurality of angular position adjusting devices each of which adjusts an angular position of a corresponding one of the work-sheet holders relative to a corresponding one of the holder connectors about a corresponding one of a plurality of axis lines each of which is parallel to the third direction, and wherein the position fixing device comprises a plurality of angular position fixing devices each of which fixes a corresponding one of the work-sheet holders at an adjusted angular position thereof relative to a corresponding one of the holder connectors about a corresponding one of the axis lines.

According to another feature of the present invention, the connecting apparatus is for connecting, as the work-sheet holder, a headgear holder which holds a headgear as the worksheet, to the feed member, wherein the apparatus further comprises a holder connecter which connects the headgear holder to the feed member such that the headgear holder is movable together with the feed member in the first direction and is rotatable relative to the feed member about an axis line parallel to the first direction, wherein the position adjusting device comprises a first adjusting device which adjusts the position of the headgear holder relative to the feed member in the first direction and a second adjusting device which adjusts an angular position of the headgear holder relative to the feed member about the axis line, the angular position of the headgear holder corresponding to the position of the headgear holder in the second direction, and wherein the position fixing device comprises a first fixing device which fixes the headgear holder at the adjusted position thereof relative to the feed member in the first direction and a second fixing device which fixes the headgear holder at the adjusted angular position thereof relative to the feed member about the axis line.

According to another feature of the present invention, the holder connector comprises a first rotatable member which is connected to the feed member such that the first rotatable member is movable together with the feed member in the first direction and is rotatable about the axis line, and a second rotatable member which is connected to the first rotatable member such that the second rotatable member is movable together with the first rotatable member and the feed member in the first direction and is rotatable together with the first rotatable member about the axis line and to which the headgear holder is connected.

According to another feature of the present invention, the first adjusting device adjusts a position of one of the headgear holder and the second rotatable member relative to a corresponding one of the second rotatable member and the first rotatable member in the first direction and the second adjusting device adjusts an angular position of the other of the headgear holder and the second rotatable member relative to the other of the second rotatable member and the first rotatable member about the axis line, and wherein the first fixing device fixes the one of the headgear holder and the second rotatable member at the adjusted position thereof relative to the corresponding one of the second rotatable member and the first rotatable member in the first direction and the second fixing device fixes the other of the headgear holder and the second rotatable member at the adjusted angular position thereof relative to the other of the second rotatable member and the first rotatable member about the axis line.

According to another feature of the present invention, the holder connector further comprises a third rotatable member which is connected to the second rotatable member such that the third rotatable member is movable together with the first and second rotatable members and the feed member in the first direction and is rotatable together with the first and second rotatable members about the axis line and to which the headgear holder is attached, and wherein the first fixing device comprises at least one first through-hole formed through one of the second and third rotatable members and at least one first fastener which passes through the first through-hole and fastens the one of the second and third rotatable members to the other of the second and third rotatable members and the second fixing device comprises at least one second through-hole formed through one of the first and second rotatable members and at least one second fastener which passes through the second through-hole and fastens the one of the first and second rotatable members to the other of the first and second rotatable members, and wherein the first adjusting device comprises at least one first elongate through-hole which is continuous with the first through-hole and extends in the first direction and the second adjusting device comprises at least one second elongate through-hole which is continuous with the second through-hole and extends in a circumferential direction of the one of the first and second rotatable members, the circumferential direction corresponding to the second direction.

According to another feature of the present invention, the connecting apparatus further comprises a converting device which converts the movement of the feed member in the second direction, into the rotation of the headgear holder about the axis line.

According to another feature of the present invention, the connecting apparatus is for connecting a plurality of headgear holders each of which holds a headgear on which stitches are formed by a corresponding one of a plurality of stitch-forming devices of the sewing machine, to the feed member which is fed by the feeding device in the first direction in which an elongate housing of each of the stitch-forming devices in which a loop catcher is accommodated extends, and fed in the second direction, wherein the apparatus further comprises a plurality of holder connectors each of which connects a corresponding one of the headgear holders to the feed member such that the corresponding one headgear holder is movable together with the feed member in the first direction, is not movable together with the feed member in the second direction, and is rotatable relative to the feed member about a corresponding one of a plurality of axis lines each of which is parallel to the first direction, and wherein the position adjusting device comprises a plurality of first adjusting devices each of which adjusts a position of a corresponding one of the headgear holders relative to the feed member in the first direction and a plurality of second adjusting devices each of which adjusts an angular position of a corresponding one of the headgear holders relative to the feed member about a corresponding one of the axis lines, the angular position of the corresponding one headgear holder corresponding to a position of the corresponding one headgear holder in the second direction, and wherein the position fixing device comprises a plurality of first fixing devices each of which fixes a corresponding one of the headgear holders at an adjusted position thereof relative to the feed member in the first direction and a plurality of second fixing devices each of which fixes a corresponding one of the headgear holders at an adjusted angular position thereof relative to the feed member about a corresponding one of the axis lines. In this case, an operator can easily set a headgear such as a cap on each of the headgear holders because, after having set the headgear on each holder, the operator can finely adjust with accuracy the positions of each individual holder relative to the feed member in the first and second directions by operating the first and second adjusting devices and the first and second fixing devices associated with each holder. That is, the operator does not have to position with accuracy a sewing area of the headgear relative to each holder when setting the headgear on the holder. Thus, the work efficiency of the operator is much improved.

According to another feature of the present invention, the connecting apparatus further comprises a converting device which converts the movement of the feed member in the second direction, into the rotation of the corresponding one headgear holder about the corresponding one axis line.

According to another feature of the present invention, the connecting apparatus is for connecting a plurality of headgear holders each of which holds a headgear on which stitches are formed by a corresponding one of a plurality of stitch-forming devices of the sewing machine, to a first feed member which is fed by the feeding device in the first direction in which an elongate housing of each of the stitch-forming devices in which a loop catcher is accommodated extends, and to a second feed member which is movable together with the first feed member in the first direction and is fed relative to the first feed member in the second direction by the feeding device, wherein the apparatus further comprises a plurality of holder connectors each of which connects a corresponding one of the headgear holders to the first and second feed members such that the corresponding one headgear holder is movable together with the first and second feed members in the first direction, is not movable together with the second feed member in the second direction, and is rotatable relative to the first and second feed members about a corresponding one of a plurality of axis lines each of which is parallel to the first direction, and wherein the position adjusting device comprises a plurality of first adjusting devices each of which adjusts a position of a corresponding one of the headgear holders relative to the first feed member in the first direction and a plurality of second adjusting devices each of which adjusts an angular position of a corresponding one of the headgear holders relative to the second feed member about a corresponding one of the axis lines, the angular position of the corresponding one headgear holder corresponding to a position of the corresponding one headgear holder in the second direction, and wherein the position fixing device comprises a plurality of first fixing devices each of which fixes a corresponding one of the headgear holders at an adjusted position thereof relative to the first feed member in the first direction and a plurality of second fixing devices each of which fixes a corresponding one of the headgear holders at an adjusted angular position thereof relative to the second feed member about a corresponding one of the axis lines. In this case, an operator can easily set a headgear such as a cap on each of the headgear holders because, after having set the headgear on each holder, the operator can finely adjust with accuracy the positions of each individual holder relative to the first and second feed members in the first and second directions by operating the first and second adjusting devices and the first and second fixing devices associated with each holder. That is, the operator does not have to position with accuracy a sewing area of the headgear relative to each holder when setting the headgear on the holder. Thus, the work efficiency of the operator is much improved.

According to another feature of the present invention, the connecting apparatus further comprises a converting device which converts the movement of the second feed member in the second direction, into the rotation of the corresponding one headgear holder about the corresponding one axis line.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
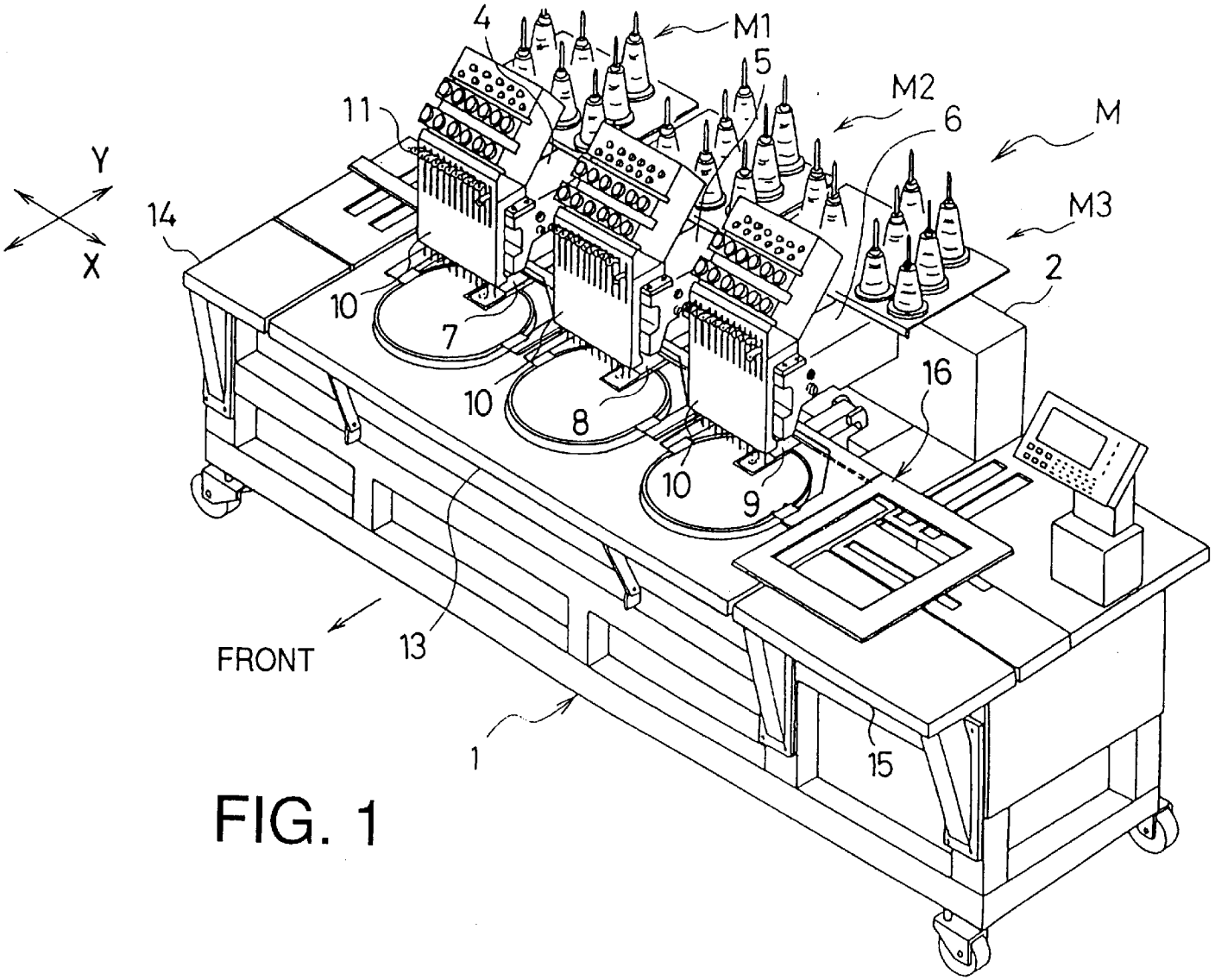
FIG. 1 is a perspective view of a multiple-head embroidering machine including a work-sheet holder connecting apparatus embodying the present invention.

FIG. 1 shows a multiple-head embroidering machine, M, including a work-sheet holder connecting apparatus to which the present invention is applied. The embroidering machine M includes three multiple-needle sewing machines M1, M2, M3.

As shown in FIG. 1, the embroidering machine M includes an elongate base frame 1 which extends in an X direction. A common support frame 2 which also extends in the X direction is provided on a rear portion of an upper face of the base frame 1. The support frame 2 supports three sewing heads 4, 5, 6 such that the three sewing heads 4–6 are equidistant from one another in the X direction. Respective end portions of three sewing beds 7, 8, 9 which correspond to the three sewing heads 4–6, respectively, are supported by the base frame 1. The three sewing beds 7–9 are independent of one another, and each extend in a Y direction perpendicular to the X direction.

Thus, the three multi-needle sewing machines M1–M3 are provided by the three sewing heads 4–6 supported by the support frame 2, and the three sewing beds 7–9 corresponding to the three sewing heads 4–6, respectively.

A front end portion of the sewing head 4–6 of each sewing machine M1–M3 supports twelve needle bars (not shown) which are arranged in an array extending in the X direction such that one of the twelve needle bars which is indexed at an operating position is reciprocated up and down by a main drive motor (not shown) via a main drive shaft (not shown). Each sewing head 4–6 additionally has twelve take-up levers 11 which correspond to the twelve needle bars, respectively, and one of the twelve take-up levers 11 which corresponds to the said one needle bar being indexed at the operating position is swung in synchronism with the reciprocation of the said one needle bar. The needle bars and the take-up levers 11 are accommodated in a needle-bar case 10, which is supported by each sewing head 4–6 such that the needle-bar case 10 is movable in the X direction. The respective needle-bar cases 10 of the three sewing heads 4–6 can be moved in the X direction, simultaneously with one another, by a needle-bar indexing device (not shown) which is driven by a needle-bar indexing motor (not shown), so that color embroidering threads conveyed by a current group of three sewing needles being indexed at the respective operating positions are changed to different color embroidering threads conveyed by a new group of three sewing needles.

A horizontal work table 13 is provided above the base frame 1 such that the upper surface of the work table 13 is flush with those of the sewing beds 7–9. Two end Y-direction feeding devices which are provided on two opposite side tables 14, 15 as viewed in the X direction cooperate with each other to feed a feed frame 16 in the Y direction. The feed frame 16 extends over the work table 13 and the two side tables 14, 15. The feed frame 16 is also fed in the X direction by an X-direction feeding device. Thus, the feed frame 16 is movable to any position in a two-dimensional X-Y coordinate plane defined by the X and Y directions.

Each sewing machine M1–M3 employs a needle-bar drive device (not shown) which receives the drive force from the main drive motor via the main drive shaft and reciprocates up and down the needle bar being indexed at the operating position, and a needle-bar jumping device (not shown) which causes the needle bar to jump up to its upper-dead position so that a new needle bar may be indexed at the operating position. Since the needle-bar drive device and the needle-bar jumping device are well known in the art, the description thereof is omitted from the following description.

Figure 2:
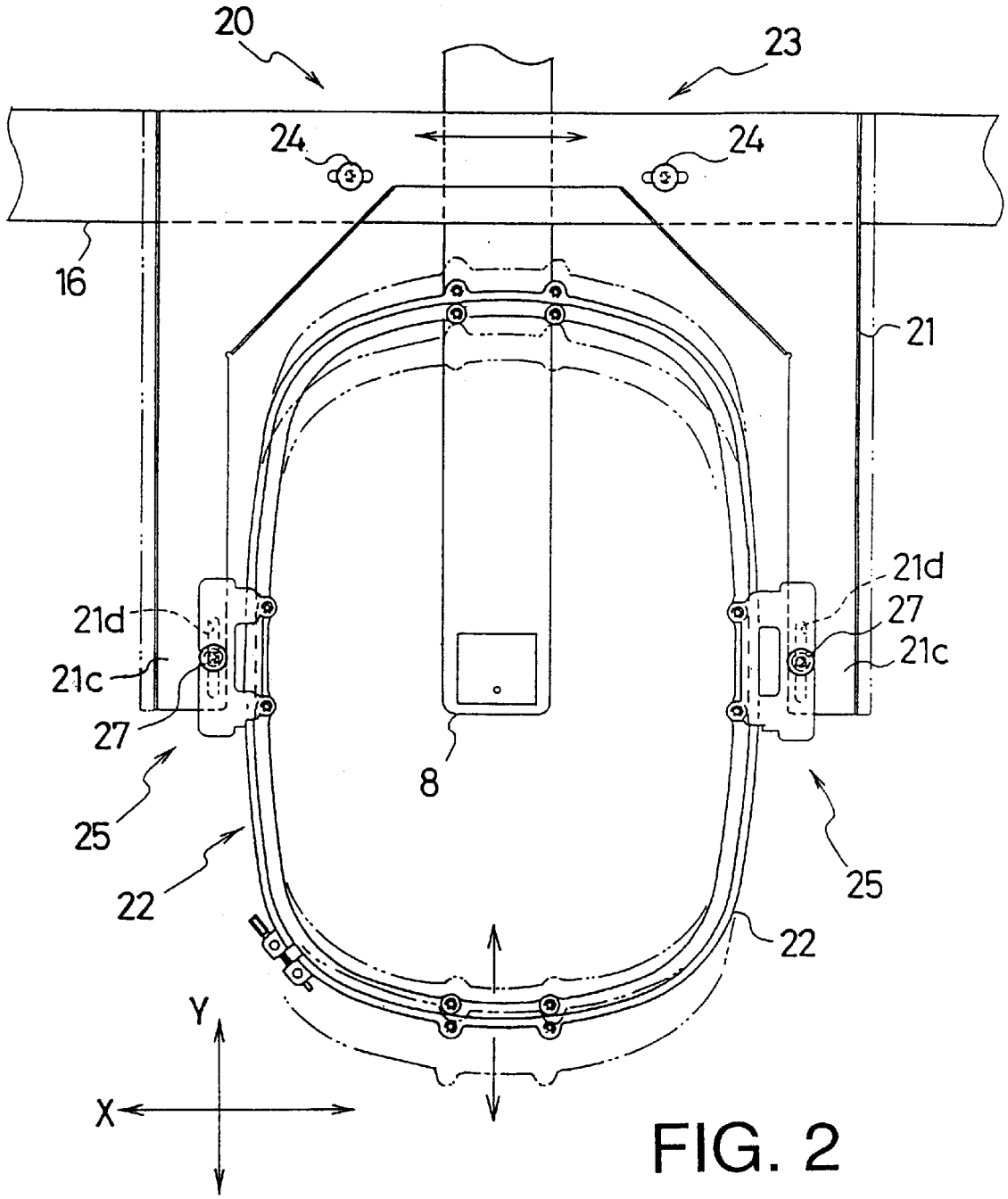
FIG. 2 is a plan view illustrating operations of the work-sheet holder connecting apparatus for adjusting the respective positions of a work-sheet holder in an X and a Y direction.
Figure 3:
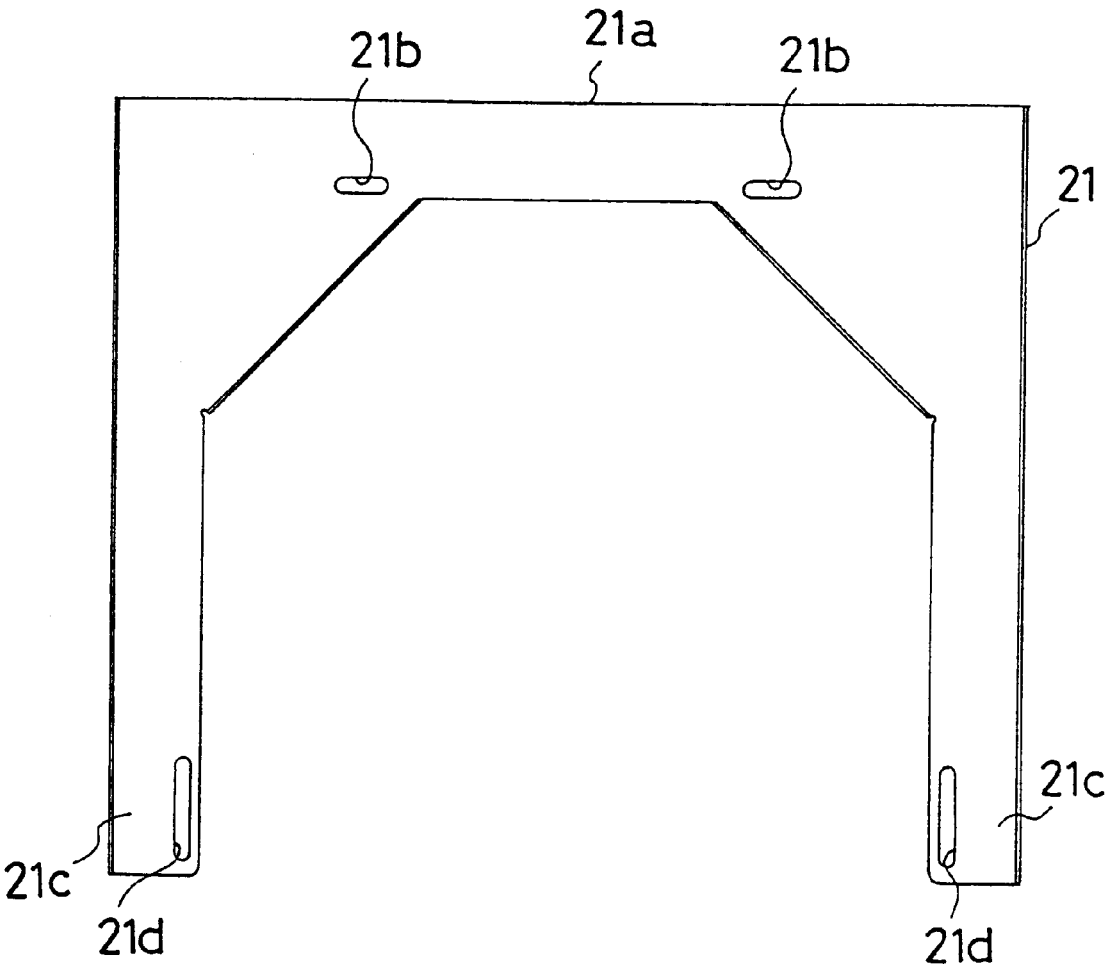
FIG. 3 is a plan view of a connector member which connects the work-sheet holder to a feed frame of the embroidering machine.
Figure 4:
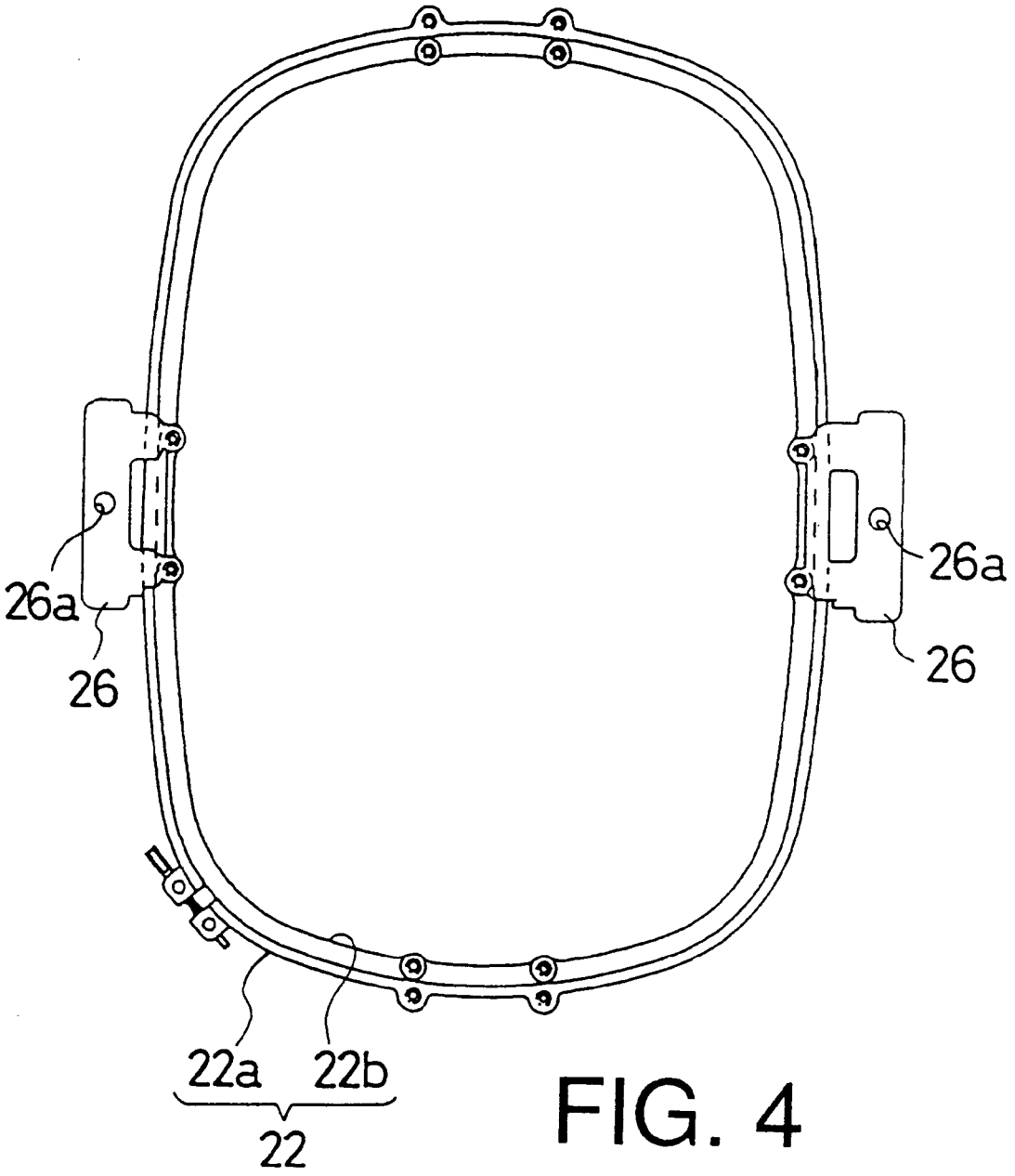
FIG. 4 is a plan view of the work-sheet holder for holding a work sheet on which embroidering stitches are formed by a corresponding one of three sewing heads of the embroidering machine.

Referring next to FIGS. 2 to 4, there will be described a work-sheet holder connecting apparatus 20 of each of the three sewing machines M1–M3. Since the three sewing machines M1–M3 have identical connecting apparatuses 20, the connecting apparatus 20 of the middle machine M2 will be described below. The connecting apparatus 20 connects a work-sheet holder 22 to the feed frame 16. The holder 22 holds a work sheet, such as a fabric or a leather, on which embroidering stitches are formed by the middle machine M2.

The connecting apparatus 20 includes a connector member 21, a first fixing device 23 which releasably fixes the connector member 21 to the feed frame 16, and two second fixing devices 25 which releasably fix the work-sheet holder 22 to the connector member 21. First, the first fixing device 23 will be described in detail below.

As shown in FIG. 3, the connector member 21 is provided by a plate member, and has a generally U-shaped shape in its plan view. The connector member 21 includes a first connecting portion 21*a* which has two elongate through-holes 21*b*, 21*b* which are spaced from each other by a predetermined distance in the X direction and each of which extends in the X direction and is formed through the thickness thereof. An externally threaded vis 24 having a knob passes through each of the two elongate holes 21*b* and is threadedly engaged with an internally threaded hole (not shown) formed in the feed frame 16. When the two vises 24 are tightened, the connecting portion 21*a* is fastened to the feed frame 16; and when the two vises 24 are loosened, the connecting portion 21*a* is unfastened from the feed frame 16, so that the position of the connector member 21 relative to the feed frame 16 in the X direction can be adjusted by moving the connector member 21 relative to the frame member 16 in the X direction while the two elongate holes 21*b* are moved relative to the two vises 24, respectively.

Next, there will be described the second fixing devices 25.

The two second fixing devices 25 include two elongate through-holes 21*d*, 21*d*, respectively, which are formed through two second connecting portions 21*c*, 21*c* of the connector member 21, respectively, and each of which extends in the Y direction. An externally threaded vis 27 having a knob passes through each of the two elongate holes 21*d* and is threadedly engaged with an internally threaded hole of a nut (not shown) provided under the connector member 21.

The work-sheet holder 22 includes an outer frame 22*a* and an inner frame 22*b* which cooperate with each other to sandwich the work sheet. A pair of ear plates 26, 26 each of which has a though-hole 26*a* are fixed to the inner frame 22*b*. The two vises 27 pass through the two holes 26*a* of the two ear plates 26 and the two elongate holes 21*d* of the connector plate 21, respectively, and are threadedly engaged with the two nuts provided under the connector member 21, respectively. When the two vises 27 and the two nuts are tightened, the work-sheet holder 22 is fastened to the second connecting portions 21*c* of the connector member 21; and when the two vises 27 and the two nuts are loosened, the work-sheet holder 22 is unfastened from the connector member 21, so that the position of the holder 22 relative to the connector member 21 in the Y direction can be adjusted by moving the holder 22 relative to the connector member 21 in the Y direction while the two vises 27 and the two nuts are moved relative to the two elongate holes 21*d*, respectively.

The respective widths of the two elongate holes 21*d* are greater by a predetermined value than the respective diameters of respective shafts of the two vises 27. Thus, when the two vises 27 and the two nuts are loosened, the work-sheet holder 22 is unfastened from the connector member 21, so that an angular position (i.e., rotation position) of the work-sheet holder 22 relative to the connector member 21 or the feed frame 16 about a vertical axis line can be adjusted by rotating the holder 22 relative to the connector member 21 about the vertical axis line.

Next, there will be described the operation of the work-sheet holder connecting apparatus 20 constructed as described above.

First, a work sheet is held on the work-sheet holder 22 such that an embroidering area of the sheet in which an embroidery pattern is to be formed is placed within the frames 22*a*, 22*b* of the holder 22. Then, the two vises 24 are loosened, the position of the connector member 21 is adjusted relative to the feed frame 16 in the X direction, as shown in FIG. 2, and the two vises 24 are fastened. Thus, the first fixing device 23 also functions as a first adjusting device for adjusting the position of the connector member 21 relative to the feed frame 16 in the X direction.

Second, the two vises 27 and the two nuts are loosened, the position of the work-sheet holder 22 is adjusted relative to the connector member 21 in the Y direction, as shown in FIG. 2, and the two vises 27 and the two nuts are fastened. Thus, the second fixing device 25 also functions as a second adjusting device for adjusting the position of the work-sheet holder 22 relative to the connector member 21 in the Y direction.

Figure 5:
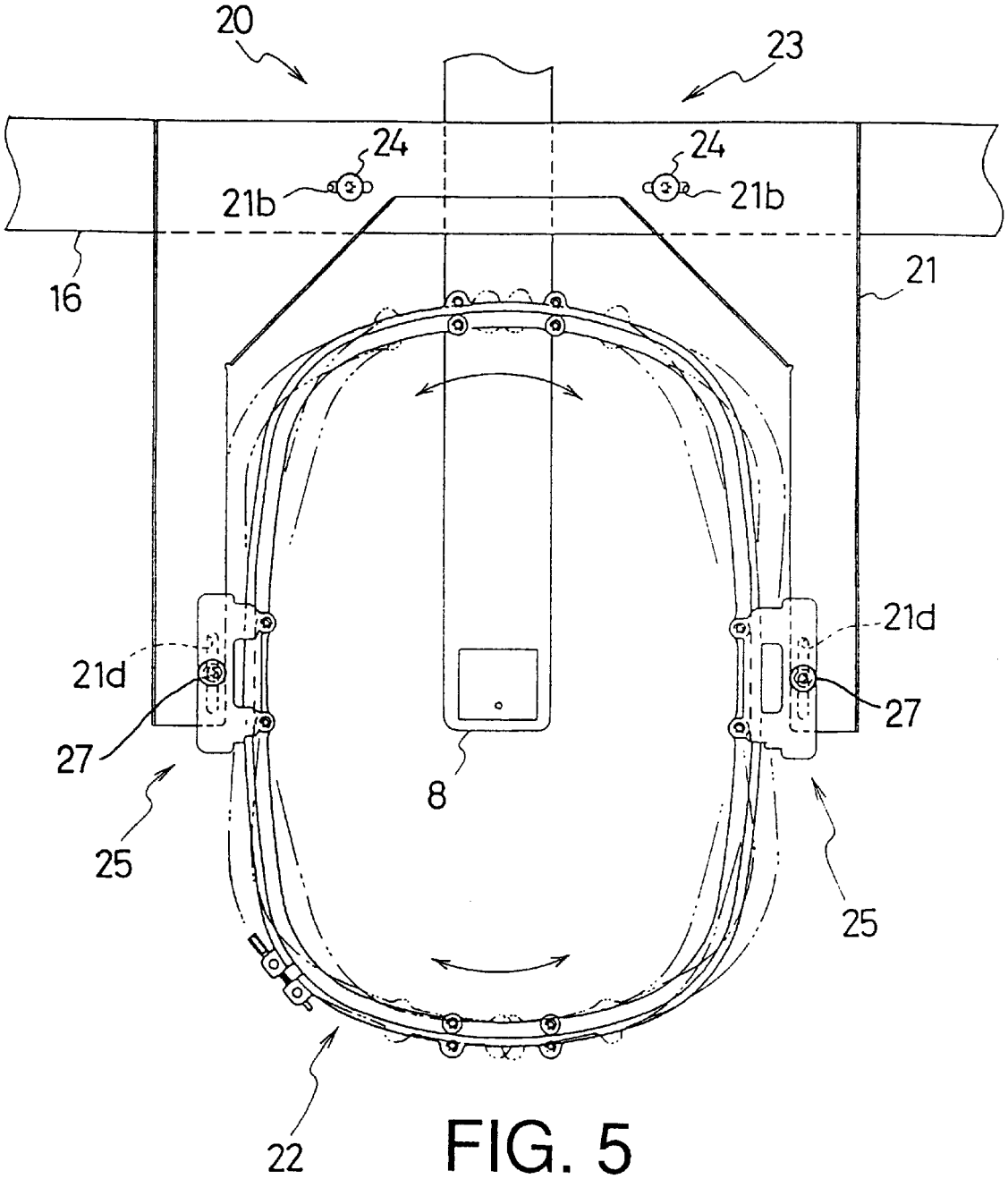
FIG. 5 is a plan view illustrating an operation of the work-sheet holder connecting apparatus for adjusting the angular position of the work-sheet holder about a vertical axis line perpendicular to the X and Y directions.

Third, when the two vises 27 and the two nuts are loosened, the angular position of the work-sheet holder 22 relative to the connector member 21 about the vertical axis line can be adjusted by rotating the holder 22 relative to the connector member 21 in a clockwise or counterclockwise direction, as shown in FIG. 5. Then, the two vises 27 and the two nuts are fastened. Thus, the second fixing device 25 also functions as an angular-position adjusting device for adjusting the angular position of the work-sheet holder 22 relative to the connector member 21 about the vertical axis line and an angular-position fixing device for fixing the work-sheet holder 22 at the adjusted angular position thereof relative to the connector member 21 about the vertical axis line.

In the present embodiment, the work-sheet holder connecting apparatus 20 includes the connector member 21, the first fixing device 23 which fixes the connector member 21 to the feed frame 16, and the second fixing device 25 which fixes the work-sheet holder 22 to the connector member 21. The first fixing device 23 also functions as the first adjusting device for adjusting the position of the connector member 21 relative to the feed frame 16 in the X direction, and the second fixing device 25 also functions as the second adjusting device for adjusting the position of the work-sheet holder 22 relative to the connector member 21 in the X direction, and additionally functions as the angular-position adjusting and fixing devices for adjusting the angular position of the work-sheet holder 22 relative to the connector member 21 about the vertical axis line and fixing the work-sheet holder 22 at the adjusted angular position thereof relative to the connector member 21 about the vertical axis line. Therefore, an operator has only to set the work sheet on the work-sheet holder 22 such that the embroidering area of the sheet falls inside the frames 22*a*, 22*b* of the holder 22. In each of the three sewing machines M1–M3, the X-direction, Y-direction, and angular positions of the work-sheet holder 22 can be finely adjusted with accuracy. Thus, the operator can easily set the work sheet on the work-sheet holder and can easily adjust the X-direction, Y-direction, and angular positions of the embroidering area of the work sheet relative to the feed frame 16. Therefore, the work efficiency of the operator is improved.

Figure 6:
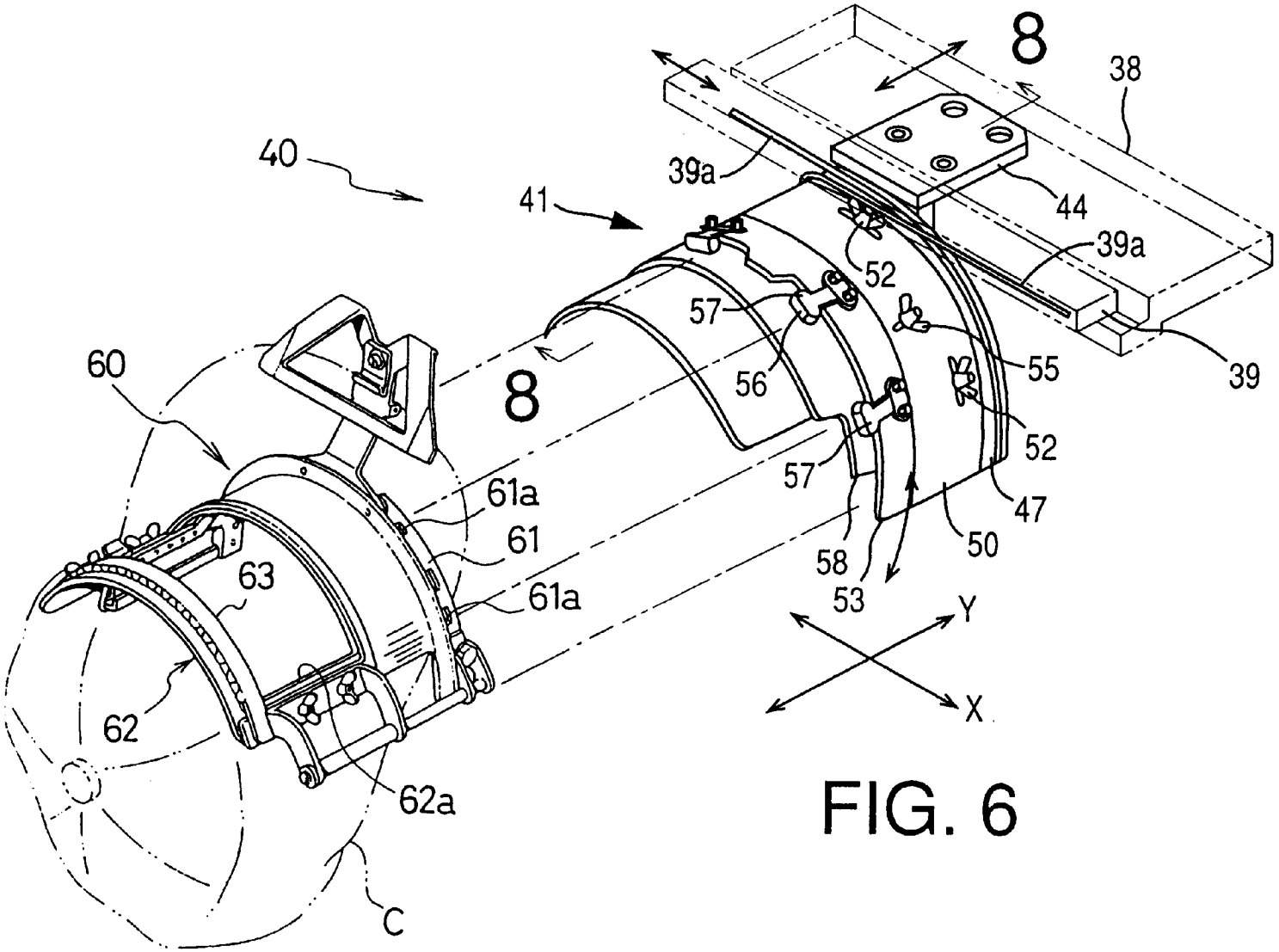
FIG. 6 is a perspective view of a headgear holder connecting apparatus as a second embodiment of the present invention, and a headgear holder which is connected by the connecting apparatus to a first and a second feed member of a multiple-head embroidering machine.
Figure 7:
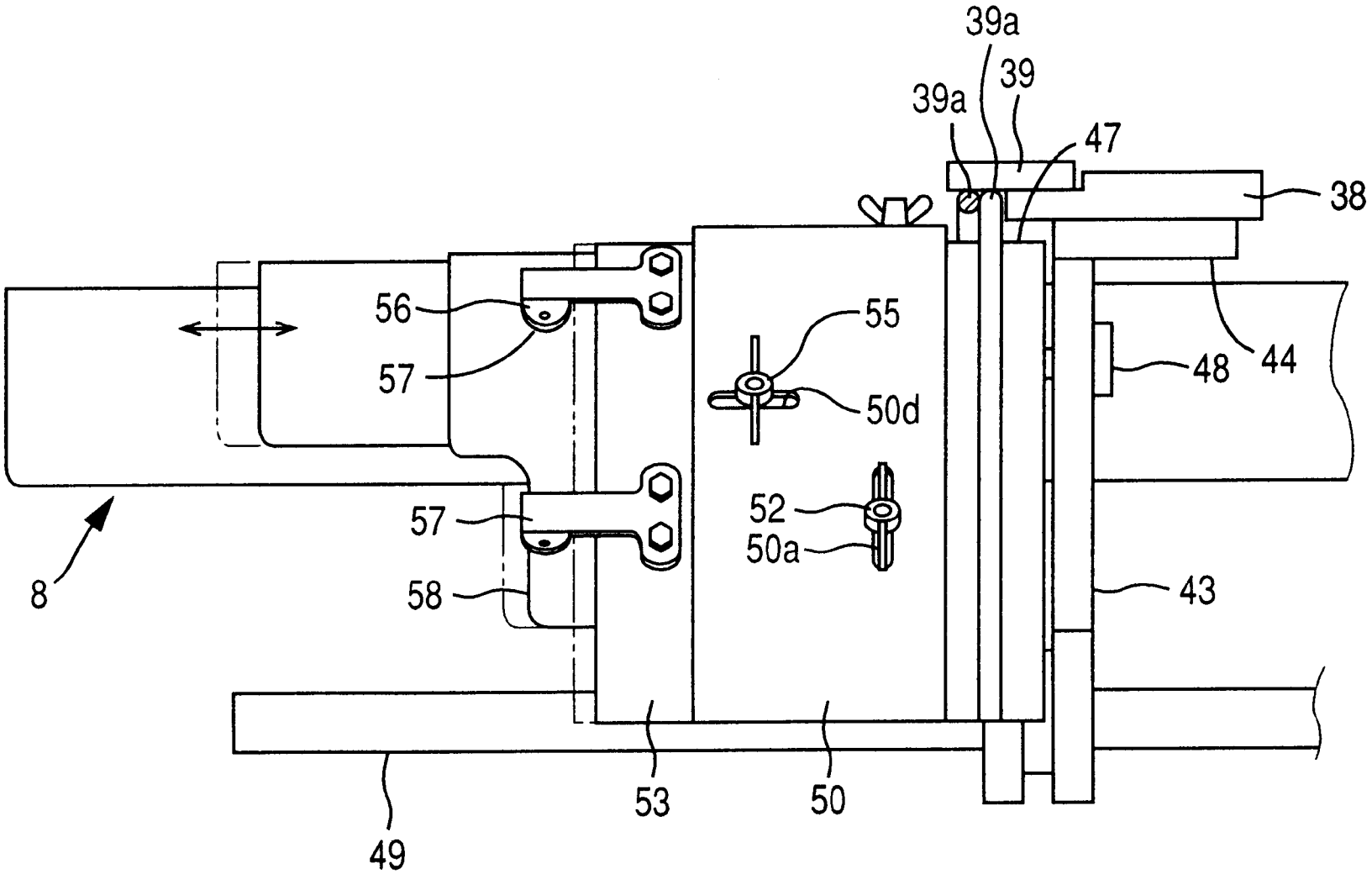
FIG. 7 is a side view of the headgear holder connecting apparatus of FIG. 6.
Figure 8:
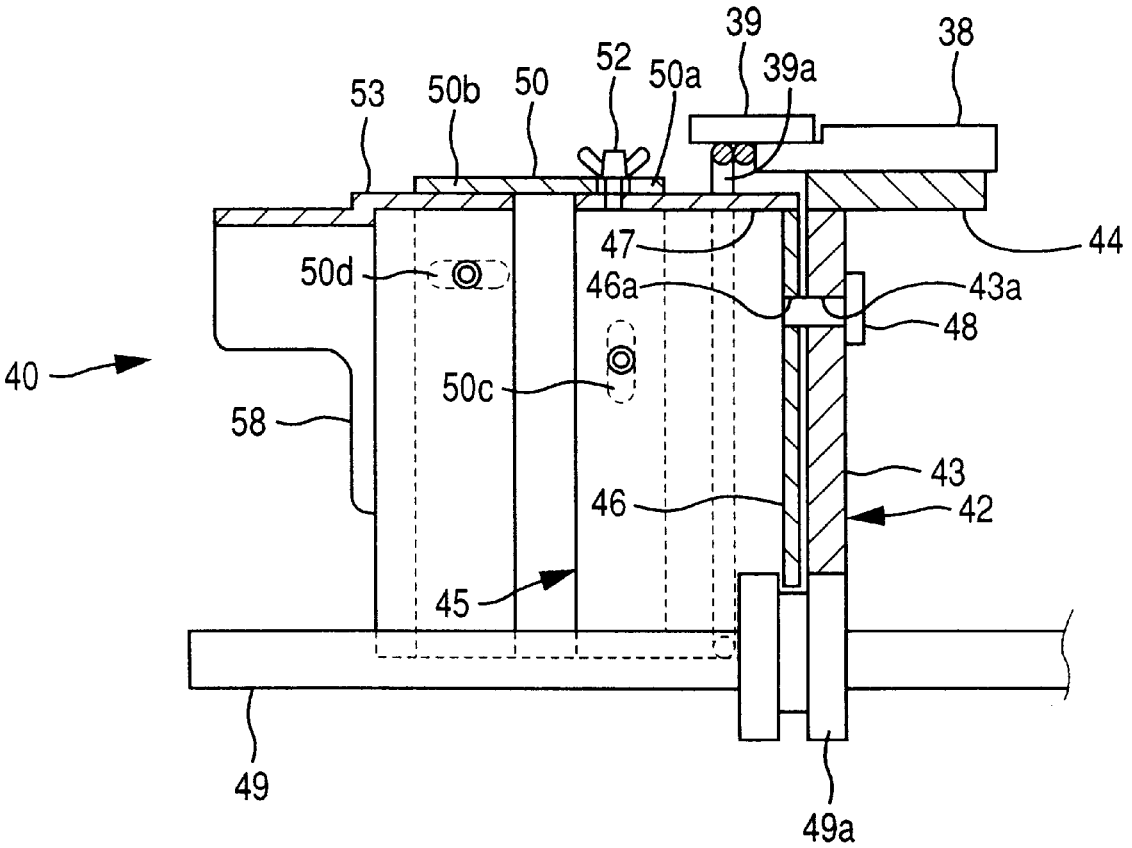
FIG. 8 is a cross section of the headgear holder connecting apparatus of FIG. 6 taken along Line 8—8.

Referring next to FIGS. 6 to 8, there will be described a second embodiment of the present invention. The second embodiment also relates to a multiple-head embroidering machine having a construction similar to that of the machine M shown in FIG. 1. However, the second embroidering machine has a first and a second feed member 38, 39 in place of the feed frame 16 of the first machine M, and each of the three sewing machines M1–M3 of the second machine includes a headgear holder connecting apparatus 40 in place of the work-sheet holder connecting apparatus 20. Each sewing machine M1–M3 also includes a headgear holder 60 for holding a headgear, C, such as a cap or a hat, on which embroidering stitches are formed by itself, and a frame device 41 which cooperates with the connecting apparatus 40 to connect the headgear holder 60 to the first and second feed members 38, 39. The frame device 41 is fixed to the first feed member 38, and is connected to the second feed member 39 via two wires 39*a*.

There will be described only the headgear holder connecting apparatus 40 associated with the middle sewing machine M2 including the sewing bed 8, since the respective connecting apparatuses 40 of the three sewing machines M1–M3 have an identical construction. It is assumed that the work table 13 is taking its lower position where the table 13 does not interfere with an operator who sets the headgear holders 60 on the respective frame devices 41 of the three sewing machines M1–M3.

The first feed member 38 which extends in the X direction is fed above the respective sewing beds 7–9 of the sewing machines M1–M3 in the Y direction by the two end Y-direction feeding devices (not shown). The second feed member 39 which also extends in the X direction is supported on the first feed member 38 such that the second feed member is movable or slideable relative to the first feed member 38 in the X direction by the X-direction feeding device (not shown).

The frame device 41 is fixed to the first feed member 38, and the headgear holder 60 holding the headgear C is detachably attached to the frame device 41.

The frame device 41 includes a block member 44 which is fixed to a lower surface of the first feed member 38 with vises (not shown), and a main frame member 42 which is provided by a support plate 43 having a generally semicircular shape in its front view, which is fixed to the block member 44, and which includes an arcuate guide hole 43*a* through which a bolt 48 passes.

The headgear holder connecting apparatus 40 includes a first semicylindrical rotatable member 45, a second semicylindrical rotatable member 50 which is fixed to the first rotatable member 45 by a second fixing device 52, and a third semicylindrical rotatable member 53 which is fixed to the second rotatable member 50 by a first fixing device 55.

The first rotatable member 45 which is provided in front of the main frame member 42 includes a slide plate 46 having a generally semicircular shape in its front view, and a semicylindrical curved plate 47 which is fixed at its rear end thereof to the outer peripheral portion of the slide plate 46 and which extends in the Y direction over a predetermined length. The bolt 48 which passes through the arcuate guide hole 43a is threadedly engaged with an internally threaded hole formed through the thickness of the slide plate 46. The slide plate 46 is rotatably supported at its lower end thereof on a shaft member 49 via a movable member 49*a* which is movable on the shaft member 49 in the Y direction. The shaft member 49 extends in the Y direction, and is detachably attached at its rear end portion thereof to the base frame 1 below the sewing bed 8. Meanwhile, the first rotatable member 45 is connected to the second feed member 39 via two metal wires 39*a*, 39*a*. Thus, the first rotatable member 45 is connected to the first feed member 38 via the bolt 48, the main frame member 42, and the block member 44 such that the first rotatable member 45 is movable in the Y direction when the first feed member 38 is fed or moved in the Y direction, and is supported on the shaft member 49 such that the first rotatable member 45 is rotatable about the shaft member 49 extending in the Y direction when the second feed member 39 is fed or moved in the X direction. The two metal wires 39*a* function as a converting device for converting the movement of the second feed member 39 in the X direction, into the rotation of the first rotatable member 45.

The second rotatable member 50 includes a first connecting portion 50*a* which is fixed to the semicylindrical plate 47 of the first rotatable member 45 by the second fixing device 52, such that the first portion 50*a* extends along, and over, the semicylindrical plate 47. The second rotatable member 50 additionally includes a second connecting portion 50*b* which is fixed to the third semicylindrical rotatable member 53 by the first fixing device 55, such that the second portion 50*a* extends along, and over, the third semicylindrical rotatable member 53.

The first connecting portion 50*a* of the second rotatable member 50 has three elongate through-holes 50*c* each of which is formed through the thickness thereof and extends in a circumferential direction of the portion 50*a*. The second fixing device 52 includes three externally threaded bolts each of which is threadedly engaged at one end thereof with the semicylindrical plate 47 and extends through a corresponding one of the three elongate holes 50*c*. The second fixing device 52 additionally includes three internally threaded wing nuts which are threadedly engaged with the three bolts, respectively. Thus, when the wing nuts of the second fixing device 52 are loosened, the second rotatable member 50 is unfastened from the first rotatable member 45, so that an angular position of the second rotatable member 50 can be adjusted relative to the first rotatable member 45 about the shaft member 49 extending in the Y direction; and when the second fixing device 52 is tightened, the second rotatable member 50 is fastened to the first rotatable member 45. Thus, the second fixing device 52 also functions as a second adjusting device for adjusting the angular position of the second rotatable member 50 relative to the first rotatable member 45 about the shaft member 49 extending in the Y direction.

The second connecting portion 50*b* of the second rotatable member 50 has two elongate through-holes 50*d* each of which is formed through the thickness thereof and extends in the Y direction. The first fixing device 55 includes two externally threaded bolts each of which is threadedly engaged at one end thereof with the third rotatable member 53 and extends through a corresponding one of the two elongate holes 50*d*. The first fixing device 55 additionally includes two internally threaded wing nuts which are threadedly engaged with the two bolts, respectively. Thus, when the wing nuts or the first fixing devices 55 are loosened, the third rotatable member 53 is unfastened from the second rotatable member 50, so that the position of the third rotatable member 53 can be adjusted relative to the second rotatable member 50 in the Y direction; and when the first fixing device 55 is tightened, the third rotatable member 53 is fastened to the second rotatable member 50. Thus, the first fixing device 55 also functions as a first adjusting device for adjusting the position of the third rotatable member 53 relative to the second rotatable member 50 in the Y direction.

The third rotatable member 53 supports, on an outer circumferential surface thereof, four spring members 57 each of which supports, at a free end portion thereof, an engageable roller 56 such that the roller 56 is rotatable about an axis line and presses the roller 56 against an arcuate member 58 which is fixed to a front portion of the third rotatable member 53.

The headgear holder 60 includes an arcuate connecting portion 61 which externally fits on the arcuate member 58 fixed to the third rotatable member 53, and a frame portion 62 extending frontward from the connecting portion 61. The connecting portion 61 has four engageable holes 61*a* which are engageable with the engageable rollers 56. The frame portion 62 has an opening 62*a* corresponding to an embroidering portion of the headgear C. The headgear holder 60 additionally includes a pressing plate 63 which is provided by a sheet spring and which cooperates with the frame portion 62*a* to sandwich the headgear C.

Next, there will be described the operation of the headgear holder connecting apparatus 40 constructed as described above.

First, as shown in FIG. 6, the headgear C is set on the headgear holder 60 such that the embroidering area of the headgear C is positioned inside the opening 62*a* of the frame portion 62. Then, the holder 60 is attached to the frame device 41. More specifically described, the engageable rollers 56 are engaged with the engageable holes 61, so that the holder 60 is attached to the the third rotatable member 53. Subsequently, the two wing nuts of the second fixing device 52 are loosened, the angular position of the second rotatable member 50 is adjusted relative to the first rotatable member 45 about the shaft member 49 extending in the Y direction while the elongate holes 50*c* are moved relative to the wing nuts and the bolts of the second fixing device 52, and the second fixing device 52 is tightened. Thus, the second fixing device 52 is operable for adjusting the angular position of the headgear holder 60 relative to the second feed member 39 via the first and second rotatable member 49, 50 about the shaft member 49 extending in the Y direction.

Meanwhile, the wing nuts of the first fixing device 55 are loosened, the position of the third rotatable member 53 is adjusted relative to the second rotatable member 50 in the Y direction while the elongate holes 50*d* are moved relative to the wing nuts and the bolts of the first fixing device 55, and the first fixing device 55 is tightened. Thus, the first fixing device 55 is operable for adjusting the position of the headgear holder 60 relative to the first feed member 38 via the first to third rotatable members 45, 50, 53 and the frame device 41 in the Y direction.

In the second embodiment, the headgear holder connecting apparatus 40 includes the first to third rotatable members 45, 50, 53, the first fixing device 55 which fixes the third rotatable member 53 to the second rotatable member 50, and the second fixing device 52 which fixes the second rotatable member 50 to the first rotatable member 45. The headgear holder 60 is detachably attached to the third rotatable member 53. The first rotatable member 45 is connected to the first feed member 38 via the frame device 41 and the bolt 48 such that the first rotatable member 45 is moved in the Y direction when the first feed member 38 is moved in the Y direction, and the same 45 is connected to the second feed member 39 via the wires 39*a* such that the first rotatable member 45 is rotated about the shaft member 49 extending in the Y direction when the second feed member 39 is moved in the X direction. Thus, the first fixing device 55 is operable for adjusting the position of the headgear holder 60 relative to the first feed member 38 in the Y direction and the second fixing device 52 is operable for adjusting the angular position of the headgear holder 60 relative to the second feed member 39 about the shaft member 49 extending in the Y direction. Therefore, an operator has only to set the headgear C on the headgear holder 60 such that the embroidering area of the headgear C falls inside the opening 62*a* of the holder 60. In each of the three sewing machines M1–M3, the Y-direction and angular positions of the headgear holder 60 can be finely adjusted with accuracy. Thus, the operator can easily set the headgear C on the headgear holder 60 and can easily adjust the Y-direction and angular positions of the embroidering area of the headgear C relative to the first and second feed members 38, 39. Therefore, the work efficiency of the operator is improved.

Figure 9:
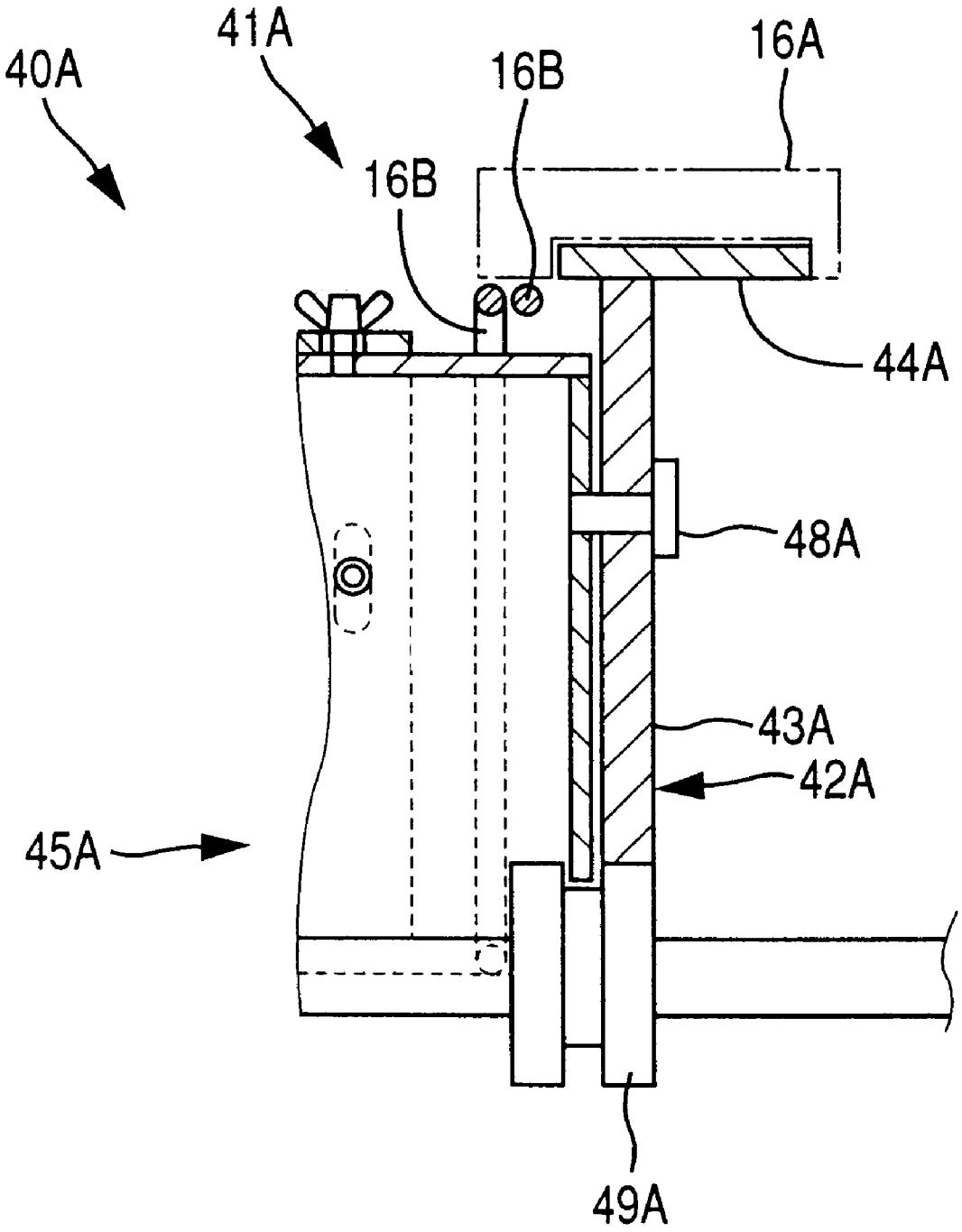
FIG. 9 is a cross section corresponding to FIG. 8, showing a headgear holder connecting apparatus, as a third embodiment of the present invention, which connects a headgear holder to a feed frame of a multiple-head embroidering machine.

Referring next to FIG. 9, there will be described a third embodiment of the present invention. The third embodiment also relates to a multiple-head embroidering machine having a construction similar to that of the first machine M shown in FIG. 1, and each of the three sewing machines M1–M3 of the third machine includes a headgear holder connecting apparatus 40A having a construction similar to that of the connecting apparatuses 40 of the second machine shown in FIGS. 6–8. However, each of the three headgear holder connecting apparatuses 40A connects a headgear holder 60 to a feed frame 16A which is fed in the X and Y directions like the feed frame 16 employed in the first machine M shown in FIG. 1.

More specifically described, the feed frame 16A is fed or moved in the Y direction by the two end Y-direction feeding devices (not shown) and is fed or moved in the X direction by the X-direction feeding device (not shown). A block member 44A to which a main frame member 42A of a frame device 41A is fixed is engaged with a lower surface of the feed frame 16A such that the block member 44A or the main frame member 42A is movable with the feed frame 16A when the feed frame 16A is moved in the Y direction and such that the main frame member 42A is not movable with the feed frame 16A (i.e., the feed frame 16A is moved or slid relative to the main frame member 42A) in the X direction even when the feed frame 16A is moved in the X direction. The main frame member 42A is provided by a support plate 43A, and has an arcuate guide hole through which a bolt 48A passes. The bolt 48A is threadedly engaged with a first rotatable member 45A. The first rotatable member 45A is connected to a lower surface of the feed frame 16A via two metal wires 16B, 16B such that the first rotatable member 45A is rotatable about a shaft member 49A extending in the Y direction when the feed frame 16A is moved in the X direction.

The first rotatable member 45A is connected to the main frame member 42A via the bolt 48A such that the first rotatable member 45A is movable with the main frame member 42A and the feed frame 16A when the feed frame 16A is moved in the Y direction. In addition, the first rotatable member 45A is supported on the shaft member 49A such that the first rotatable member 45A is movable on the shaft member 49A in the Y direction.

When the feed frame 16A is moved in the Y direction, the headgear holder 60 is moved in the Y direction via the frame device 41A, the bolt 48A, the first rotatable member 45A, and a second and a third rotatable members (not shown). When the feed frame 16A is moved in the X direction, the frame member 41A is not moved in the X direction but remains while the feed frame 16A is moved or slid relative to the frame member 41A, and the headgear holder 60 is rotated with the first rotatable member 45A about the shaft member 49A extending in the Y direction.

Thus, the third embroidering machine enjoys the same advantages as those of the second embroidering machine shown in FIGS. 6–8.

While the present invention has been described in its preferred embodiments, the invention may otherwise be embodied.

For example, in the first embodiment shown in FIGS. 1 to 5, the elongate through-holes 21*b* formed through the first connecting portion 21*a* of the connector member 21 may be replaced by one or more elongate through-holes which are formed through the thickness of the feed frame 16 and extend in the X direction. In addition, the elongate through-holes 21*d* formed through the second connecting portions 21*c* of the connector member 21 may be replaced by respective elongate through-holes which are formed through the ear plates 26 and extend in the Y direction. Moreover, the elongate through-holes 21*b* which extend in the X direction may be replaced by one or more through-holes which extend in the Y direction, and the elongate through-holes 21*d* which extend in the Y direction may be replaced by one or more through-holes which extend in the X direction.

Similarly, in each of the second and third embodiments shown in FIGS. 6–8 and FIG. 9, respectively, the elongate through-holes 50*c* formed through the first connecting portion 50*a* of the second rotatable member 50 may be replaced by one or more elongate through-holes which are formed through the thickness of the semicylindrical plate 47 of the first rotatable member 45 and extend in the circumferential direction of the same 47. In addition, the elongate through-holes 50*d* formed through the second connecting portion 50*b* of the second rotatable member 50 may be replaced by one or more elongate through-holes which are formed through the third rotatable member 53. Moreover, the elongate through-holes 50*c* which extend in the circumferential direction of the second rotatable member 50 may be replaced by one or more through-holes which extend in the Y direction, and the elongate through-holes 50*d* which extend in the Y direction may be replaced by one or more through-holes which extend in the circumferential direction of the second rotatable member 50.

In each of the illustrated embodiments, the elongate through-holes 21*b*, 21*d*, 50*c*, 50*d* function as not only part of the first or second fixing device but also part of the first or second position adjusting device. However, the first or second position adjusting device may be provided independent of the first or second fixing device.

The principle of the present invention may be applicable to a single-head sewing machine having a single sewing head and a single work-sheet holder which holds a work sheet on which stitches are formed by the sewing head.

It is to be understood that the present invention may be embodied with other changes, improvements, and modifications that may occur to the person skilled in the art without departing from the scope and spirit of the invention defined in the appended claims.

What is claimed is:

1. An apparatus for connecting a work-sheet holder which holds a work-sheet, to a feed member which is fed by a feeding device of a sewing machine along a reference plane, so that a stitch-forming device of the sewing machine forms stitches on the work-sheet held by the work-sheet holder, the apparatus comprising:

a holder connector which connects the work-sheet holder to the feed member such that the work-sheet holder is movable together with the feed member;

a position adjusting device comprising a first adjusting device which adjusts a position of the work-sheet holder relative to the holder connector in a first direction parallel to the reference plane, and a second adjusting device which adjusts a position of the holder connector relative to the feed member in a second direction which is parallel to the reference plane and is perpendicular to the first direction; and a holder fixing device comprising a first fixing device which fixes the work-sheet holder at the adjusted position thereof relative to the holder connector in the first direction, and a second fixing device which fixes the holder connector at the adjusted position thereof relative to the feed member in the second direction.

2. An apparatus according to claim 1, wherein said first fixing device comprises at least one first through-hole formed through one of the work-sheet holder and said holder connector and at least one first fastener which passes through said first through-hole and fastens said one of the work-sheet holder and said holder connector to the other of the work-sheet holder and said holder connector, and said second fixing device comprises at least one second through-hole formed through one of said holder connector and the feed member and at least one second fastener which passes through said second through-hole and fastens said one of said holder connector and the feed member to the other of said holder connector and the feed member, and wherein said first adjusting device comprises at least one first elongate through-hole which is continuous with said first through-hole and extends in the first direction, and said second adjusting device comprises at least one second elongate through-hole which is continuous with said second through-hole and extends in the second direction.

3. An apparatus according to claim 2, wherein said position adjusting device further comprises an angular position adjusting device which adjusts an angular position of the work-sheet holder relative to the feed member about an axis line perpendicular to the reference plane and which comprises at least one of said first and second elongate through-holes, and wherein said holder fixing device further comprises an angular position fixing device which fixes the work-sheet holder at the adjusted angular position thereof relative to the feed member about the axis line and which comprises at least one of said first and second through-holes and at least one of said first and second fasteners.

4. An apparatus according to claim 1, wherein said position adjusting device further comprises an angular position adjusting device which adjusts an angular position of the work-sheet holder relative to the feed member about an axis line perpendicular to the reference plane, and wherein said holder fixing device further comprises an angular position fixing device which fixes the work-sheet holder at the adjusted angular position relative to the feed member about the axis line.

5. An apparatus according to claim 1, for connecting a plurality of work-sheet holders each of which holds a work sheet on which stitches are formed by a corresponding one of a plurality of stitch-forming devices of the sewing machine, to the feed member which is fed by the feeding device in the first direction, and fed in the second direction independent of the feeding thereof in the first direction, wherein the apparatus comprises a plurality of holder connectors each of which connects a corresponding one of the work-sheet holders to the feed member such that said corresponding one work-sheet holder is movable together with the feed member in the first and second directions, and wherein said position adjusting device comprises a plurality of first adjusting devices each of which adjusts a position of a corresponding one of the work-sheet holders relative to a corresponding one of said holder connectors in the first direction and a plurality of second adjusting devices each of which adjusts a position of a corresponding one of said holder connectors relative to the feed member in the second direction, and wherein said holder fixing device comprises a plurality of first fixing devices each of which fixes a corresponding one of the work-sheet holders at an adjusted position thereof relative to a corresponding one of said holder connectors in the first direction, and a plurality of second fixing devices each of which fixes a corresponding one of said holder connectors at an adjusted position thereof relative to the feed member in the second direction.

6. An apparatus according to claim 5, wherein said position adjusting device further comprises a plurality of angular position adjusting devices each of which adjusts an angular position of a corresponding one of the work-sheet holders relative to a corresponding one of said holder connectors about a corresponding one of a plurality of axis lines each of which is perpendicular to the reference plane, and wherein said position fixing device further comprises a plurality of angular position fixing devices each of which fixes a corresponding one of the work-sheet holders at an adjusted angular position thereof relative to a corresponding one of said holder connectors about a corresponding one of the axis lines.

7. An apparatus according to claim 1, for connecting, as the work-sheet holder, a headgear holder which holds a headgear as the work-sheet, to the feed member, wherein the holder connector connects the headgear holder to the feed member such that the headgear holder is movable together with the feed member in the first direction and is rotatable relative to the feed member about an axis line parallel to the first direction, wherein the first adjusting device adjusts the position of the headgear holder relative to the feed member in the first direction and the second adjusting device adjusts an angular position of the headgear holder relative to the feed member about the axis line, said angular position of the headgear holder corresponding to the position of the headgear holder in the second direction, and wherein the first fixing device fixes the headgear holder at the adjusted position thereof relative to the feed member in the first direction and the second fixing device fixes the headgear holder at the adjusted angular position thereof relative to the feed member about the axis line.

8. An apparatus according to claim 7, wherein said holder connector comprises a first rotatable member which is connected to the feed member such that said first rotatable member is movable together with the feed member in the first direction and is rotatable about the axis line, and a second rotatable member which is connected to said first rotatable member such that said second rotatable member is movable together with said first rotatable member and the feed member in the first direction and is rotatable together with said first rotatable member about the axis line and to which the headgear holder is connected.

9. An apparatus according to claim 8, wherein said first adjusting device adjusts a position of one of the headgear holder and said second rotatable member relative to a corresponding one of said second rotatable member and said first rotatable member in the first direction and said second adjusting device adjusts an angular position of the other of the headgear holder and said second rotatable member relative to the other of said second rotatable member and said first rotatable member about the axis line, and wherein said first fixing device fixes said one of the headgear holder and said second rotatable member at the adjusted position thereof relative to said corresponding one of said second rotatable member and said first rotatable member in the first direction and said second fixing device fixes said other of the headgear holder and said second rotatable member at the adjusted angular position thereof relative to said other of said second rotatable member and said first rotatable member about the axis line.

10. An apparatus according to claim 8, wherein said holder connector further comprises a third rotatable member which is connected to said second rotatable member such that said third rotatable member is movable together with said first and second rotatable members and the feed member in the first direction and is rotatable together with said first and second rotatable members about the axis line and to which the headgear holder is attached, and wherein said first fixing device comprises at least one first through-hole formed through one of said second and third rotatable members and at least one first fastener which passes through said first through-hole and fastens said one of said second and third rotatable members to the other of said second and third rotatable members and said second fixing device comprises at least one second through-hole formed through one of said first and second rotatable members and at least one second fastener which passes through said second through-hole and fastens said one of said first and second rotatable members to the other of said first and second rotatable members, and wherein said first adjusting device comprises at least one first elongate through-hole which is continuous with said first through-hole and extends in the first direction and said second adjusting device comprises at least one second elongate through-hole which is continuous with said second through-hole and extends in a circumferential direction of said one of said first and second rotatable members, said circumferential direction corresponding to the second direction.

11. An apparatus according to claim 8, further comprising a converting device which converts the movement of the feed member in the second direction, into the rotation of the headgear holder about the axis line.

12. An apparatus according to claim 7, for connecting a plurality of headgear holders, each of which holds a headgear on which stitches are formed by a corresponding one of a plurality of stitch-forming devices of the sewing machine, to the feed member which is fed by the feeding device in the first direction in which an elongate housing of each of the stitch-forming devices in which a loop catcher is accommodated extends, and fed in the second direction, wherein the apparatus further comprises a plurality of holder connectors each of which connects a corresponding one of the headgear holders to the feed member such that said corresponding one headgear holder is movable together with the feed member in the first direction, is not movable together with the feed member in the second direction, and is rotatable relative to the feed member about a corresponding one of a plurality of axis lines each of which is parallel to the first direction, and wherein said position adjusting device comprises a plurality of first adjusting devices each of which adjusts a position of a corresponding one of the headgear holders relative to the feed member in the first direction and a plurality of second adjusting devices each of which adjusts an angular position of a corresponding one of the headgear holders relative to the feed member about a corresponding one of the axis lines, said angular position of said corresponding one headgear holder corresponding to a position of said corresponding one headgear holder in the second direction, and wherein said position fixing device comprises a plurality of first fixing devices each of which fixes a corresponding one of the headgear holders at an adjusted position thereof relative to the feed member in the first direction and a plurality of second fixing devices each of which fixes a corresponding one of the headgear holders at an adjusted angular position thereof relative to the feed member about a corresponding one of the axis lines.

13. An apparatus according to claim 12, further comprising a converting device which converts the movement of the feed member in the second direction, into the rotation of said corresponding one headgear holder about said corresponding one axis line.

14. An apparatus according to claim 7, for connecting a plurality of headgear holders each of which holds a headgear on which stitches are formed by a corresponding one of a plurality of stitch-forming devices of the sewing machine, to a first feed member which is fed by the feeding device in the first direction in which an elongate housing of each of the stitch-forming devices in which a loop catcher is accommodated extends, and to a second feed member which is movable together with the first feed member in the first direction and is fed relative to the first feed member in the second direction by the feeding device, wherein the apparatus further comprises a plurality of holder connectors each of which connects a corresponding one of the headgear holders to the first and second feed members such that said corresponding one headgear holder is movable together with the first and second feed members in the first direction, is not movable together with the second feed member in the second direction, and is rotatable relative to the first and second feed members about a corresponding-one of a plurality of axis lines each of which is parallel to the first direction, and wherein said position adjusting device comprises a plurality of first adjusting devices each of which adjusts a position of a corresponding one of the headgear holders relative to the first feed member in the first direction and a plurality of second adjusting devices each of which adjusts an angular position of a corresponding one of the headgear holders relative to the second feed member about a corresponding one of the axis lines, said angular position of said corresponding one headgear holder corresponding to a position of said corresponding one headgear holder in the second direction, and wherein said position fixing device comprises a plurality of first fixing devices each of which fixes a corresponding one of the headgear holders at an adjusted position thereof relative to the first feed member in the first direction and a plurality of second fixing devices each of which fixes a corresponding one of the headgear holders at an adjusted angular position thereof relative to the second feed member about a corresponding one of the axis lines.

15. An apparatus according to claim 14, further comprising a converting device which converts the movement of the second feed member in the second direction, into the rotation of said corresponding one headgear holder about said corresponding one axis line.

16. An apparatus according to claim 1, wherein the holder connector connects the work-sheet holder to the feed member which is fed by the feeding device of the sewing machine in each of the first direction and the second direction.

17. An apparatus for connecting a headgear holder which holds a headgear to a feed member which is fed by a feeding device of a sewing machine along a reference plane, so that a stitch-forming device of the sewing machine forms stitches on the headgear held by the headgear holder, the apparatus comprising:

a holder connector which connects the headgear holder to the feed member such that the headgear holder is movable together with the feed member in a direction parallel to the reference plane and is rotatable relative to the feed member about an axis line parallel to said direction;

a position adjusting device comprising a first adjusting device which adjusts a position of the headgear holder relative to the feed member in said direction parallel to the reference plane, and a second adjusting device which adjusts an angular position of the headgear holder relative to the feed member about the axis line parallel to said direction; and a position fixing device comprising a first fixing device which fixes the headgear holder at the adjusted position thereof relative to the feed member in said direction parallel to the reference plane, and a second fixing device which fixes the headgear holder at the adjusted angular position thereof relative to the feed member about the axis line parallel to said direction.

18. An apparatus for connecting a work-sheet holder which holds a work-sheet, to a feed member which is fed by a feeding device of a sewing machine along a reference plane, so that a stitch-forming device of the sewing machine forms stitches on the work-sheet held by the work-sheet holder, the apparatus comprising:

an angular position adjusting device which adjusts an angular position of the work-sheet holder relative to the feed member about an axis line which is perpendicular to the reference plane and which intersects an inside area defined by the work-sheet holder; and an angular position fixing device which fixes the work-sheet holder at the adjusted angular position relative to the feed member about the axis line.

19. An apparatus according to claim 18, further comprising a holder connector which connects two opposite portions of the work-sheet holder to the feed member, wherein the angular position adjusting device comprises two elongate through-holes which are formed through one of the work-sheet holder and the holder connector, are provided outside the two opposite portions of the work-sheet holder, respectively, and are elongate parallel to each other, and the angular position fixing device comprises two fasteners which pass through the two elongate through-holes, respectively, and which fasten said one of the work-sheet holder and the holder connector to the other of the work-sheet holder and the holder connector.

20. An apparatus for connecting a headgear holder which holds a headgear, to a feed member which is fed by a feeding device of a sewing machine along a reference plane, so that a stitch-forming device of the sewing machine forms stitches on the headgear held by the headgear holder, the apparatus comprising:

a holder connector which connects the headgear holder to the feed member such that the headgear holder is movable together with the feed member in a direction parallel to the reference plane and is rotatable relative to the feed member about an axis line parallel to said direction;

a position adjusting device which adjusts an angular position of the headgear holder relative to the feed member about the axis line parallel to said direction; and a position fixing device which fixes the headgear holder at the adjusted angular position thereof relative to the feed member about the axis line parallel to said direction.

21. An apparatus according to claim 20, wherein the position adjusting device comprises at least one elongate through-hole which is formed through one of the headgear holder and the holder connector, and the position fixing device comprises at least one fastener which passes through said at least one elongate through-hole and which fastens said one of the headgear holder and the holder connector to the other of the headgear holder and the holder connector.

* * * * *